United States Patent [19]

Studebaker et al.

[11] 3,961,787

[45] June 8, 1976

[54] ALL DIRECTIONS BALANCE BOARD TO ENHANCE MOTOR DEVELOPMENT OF THE CEREBRAL PALSIED CHILD

[76] Inventors: Gary W. Studebaker; Susan H. Studebaker, both of 9340 Buell St., Downey, Calif. 90241

[22] Filed: May 19, 1975

[21] Appl. No.: 578,520

[52] U.S. Cl. ..... 272/93; 272/109

[51] Int. Cl.[2] ..... A63B 23/00

[58] Field of Search ..... 272/57 R, 57 A, 57 B, 272/58, 60 R, 33 A, 52, 52.5, 54, 56, 1 R; D34/5 K

[56] References Cited

UNITED STATES PATENTS

| | | | |
|---|---|---|---|
| 1,290,562 | 1/1919 | Jacquot | 272/57 R |
| 1,370,569 | 3/1921 | Webb | 272/52 |
| 1,712,703 | 5/1929 | Hudson | 272/52 |
| 2,844,188 | 7/1958 | Thompson | 272/52 |
| 3,119,626 | 1/1964 | Strader | 272/52 |
| 3,227,445 | 1/1966 | Jensen | 272/56 |
| 3,604,722 | 9/1971 | Boley | 272/1 R |
| D134,341 | 11/1942 | Churchill | D34/5 K |

*Primary Examiner*—Anton O. Oechsle
*Assistant Examiner*—Harry G. Strappello
*Attorney, Agent, or Firm*—Dominick Nardelli

[57] ABSTRACT

A device designed to enhance motor development in children with cerebral palsy and related disorders, which has a board-type body and an element on its underside to provide for a tilt movement of the board-type body in all directions about a center. The body is preferably rectangular in shape and has two handrails at the sides and has one pair of handholds spaced inward from its edge. The purpose of the handrails and handholds is to allow a child to grasp the device for support and stabilization while lying in the prone position and to allow for motor development of the hand and arm. The device has a removable handlebar and post extending upward from the body to allow a child that is more physically advanced to use the device while in a sitting or kneeling position.

4 Claims, 4 Drawing Figures

ALL DIRECTIONS BALANCE BOARD TO ENHANCE MOTOR DEVELOPMENT OF THE CEREBRAL PALSIED CHILD

Field of the Invention

This invention relates to a device for assisting a child with cerebral palsy or other related disorders toward normal motor development landmarks.

BACKGROUND OF THE INVENTION

Children with cerebral palsy can be helped to grow and develop more normally if one takes the time and patience to provide appropriate motor experiences that meet their needs and are motivating to the child. Children with cerebral palsy, due to brain damage, do not adequately move their bodies to perform motor functions. A motor development program initiated early enough in life can be beneficial in inhibiting abnormal postures and movement and promoting normal motor responses. When cerebral palsied children have severe motor impairments, they are often capable of maintaining only a prone, supine or propped sitting position. The prior art toys or devices, as used by normal children, are difficult for this type of child to handle since his motor abilities do not lend themselves to the use of these prior art devices. The art device that we are introducing is not only capable of handling the cerebral palsied child according to his motor development level, but it also provides for grasping in various positions for stability and hand development.

SUMMARY OF THE INVENTION

Briefly, our device consists of a board-type body, having a means fastened to its bottom side to allow the board to roll on the floor. The body is preferably rectangular in shape and has, for its means, a longitudinal rocker member and a transverse rocker member which cross at the center thereof, at a right angle. The radius of the curvature of both rockers is relatively large so that relatively small aptitude rolling action is provided. To assist a child in a prone position to hold his position on the flat surface of the body, a pair of handrails are provided spaced therefrom and in the plane thereof. Also, handholds are suitably placed in the flat surface of the body. This aids a child to use the device, as he is able to grasp for stability and move his body weight the slight amount required to place the surface in a horizontal position. Further, to aid a child to use the device in a sitting or kneeling position, an upright handlebar assembly is removably attached to the body. The assembly has a handlebar for the sitting or kneeling child to hold.

OBJECTS OF THE INVENTION

An object of the invention is to provide an economical, simple device to aid cerebral palsied children to develop toward more normal motor landmarks.

Another object of this invention is to provide a device that can be used in a prone, supine, sitting and kneeling position.

Another object of this invention is to provide a flat surface capable of supporting a cerebral palsied child, which surface is capable of rolling to and fro, from side to side, or any diagonal direction, and return to its horizontal position even when a handicapped child is thereon.

Another object of the invention is to provide the cerebral palsied child with many balancing and grasping experiences to enhance motor development.

Another object of the invention is that as a child progresses in his motor abilities, this device is capable of handling the various progressive motor positions.

These and other objects and features of advantage will become more apparent after studying the following description of the preferred embodiment of our invention, together with the appending drawings.

DETAILED DESCRIPTION OF THE DRAWING

Figure 1:
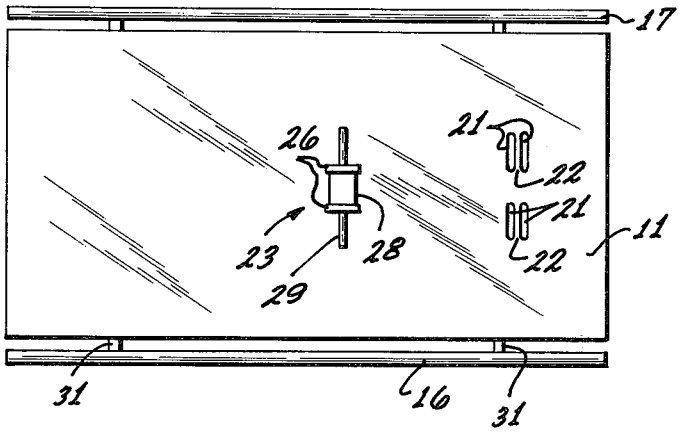
FIG. 1 is a plan view of the device shown in FIG. 1.
Figure 2:
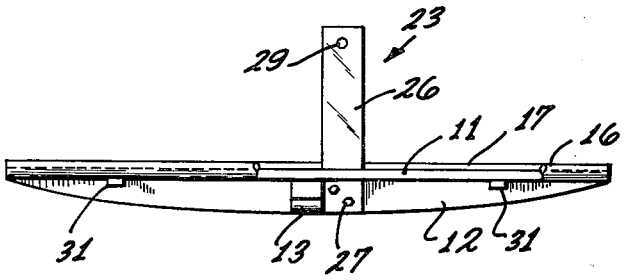
FIG. 2 is a side elevation of our novel device, with a portion broken away.
Figure 3:
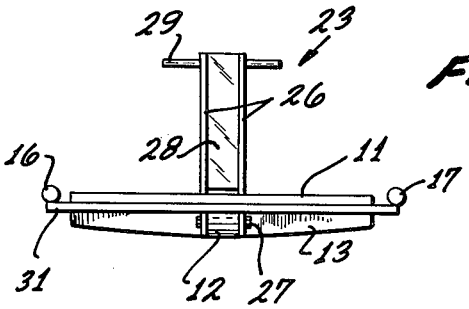
FIG. 3 is an end view thereof.
Figure 4:
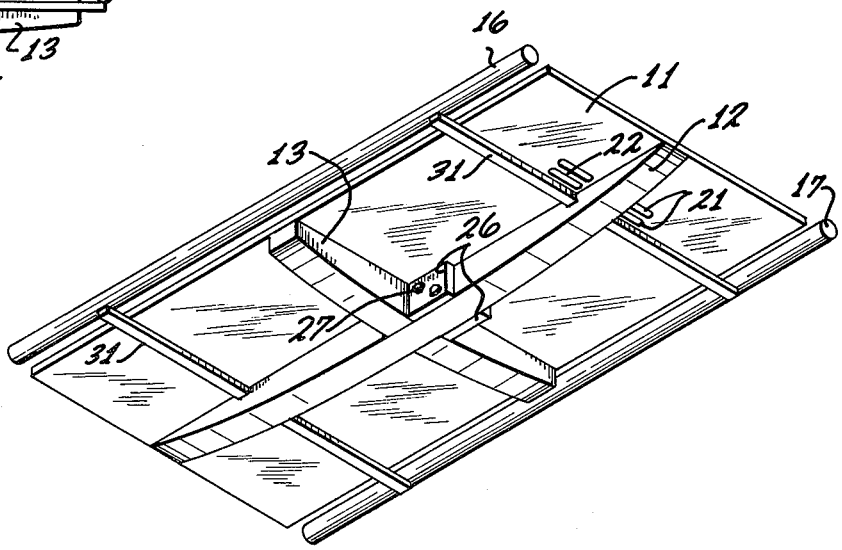
FIG. 4 is a pictorial view thereof, showing the underside.

Referring to the drawing, our novel device has a body 11 made of, for example, ¾ inch plywood board. On the under side of the body 11 are placed means to allow the body to roll slightly from its horizontal position when placed on a level surface. This rolling action, besides being in a transverse direction, is also in the fore and aft direction and any diagonal direction. The means is in the form of two rockers 12 and 13 placed criss-cross to the other side, as shown in FIG. 4. The curvature of both rockers 12 and 13 are preferably equal to each other. If the body is 4 feet long, preferably the height of the segment of the circle (cut by the chord) is no more than 2 inches. This arrangement of the rockers allows the body to roll when an unbalanced weight is placed thereon. Therefore, if a child with cerebral palsy is laid on the body in a prone position, the body would roll slightly, and the common reaction of a handicapped child is to try to right itself. Since the roll is slight, only a slight correction force is required, which is within the capabilities of a handicapped child. A greater curvature on the rockers would be more difficult for the child to correct his position, as increased motor abilities would be required than the child may have developed.

To assist the handicapped child to develop a greater correcting force, the body 11 is provided with handrails 16 and 17, one on each side. These rails 16 and 17 are fixedly spaced from the body 11 by suitable supports, such as wood strips 31, as shown. In addition, two sets of two holes 21 are provided in a rectangular formed, as shown, to form a pair of bars 22 onto which the child can also grasp.

As the child develops and is capable of sitting, the device has a removable handlebar assembly 23 extending up from the body. In this embodiment, assembly 23 consists of a post made of two bars 26 that extend through suitable holes in the body to straddle the fore and aft rocker 12, and are suitably bolted thereto by a nut and bolt assembly 27. Above the body, the bars 26 sandwich a spacer bar 28, for obvious reasons. A handlebar 29 is fixed horizontally to the bars 26. With the handlebar assembly 23 in place, a child can sit on the body 11, grasp onto the handlebars and tilt himself or be tilted in any direction, to develop his balancing, grasping and other motor abilities.

Although one embodiment of our invention has been described, one skilled in the art, after studying the above preferred embodiment, can devise other embodiments without departing from the spirit and scope of our invention. Therefore, our invention is to be considered to include all embodiments falling within the scope of the claims.

We claim:

1. A device comprising:

a board with a substantially flat, rectangular surface;

means on said board, opposite said flat surface, for allowing said board to tilt slightly from its horizontal position;

means disposed in the plane of said surface for allowing a user to grasp the device;

a removable handlebar assembly adapted to extend upward from said flat surface;

said means for tilting including a longitudinal rocker and a transverse rocker, each having a curvature equal to each other;

said handlebar assembly comprising:

a post having two spaced bars extending from one end, and a handlebar disposed at the other end, said board having a pair of holes disposed on opposite sides of said longitudinal rocker and each adapted to receive a respective bar; and means for fastening said bars to said longitudinal rocker.

2. The device of claim 1 wherein said means for grasping comprises:

a pair of rails disposed longitudinally on opposite sides of said board;

a pair of transversely disposed strips fastened to the underside of said board on both opposite sides of said longitudinal rocker and protruding laterally from said board;

one of said rails fastened to respective ends of said pair of said strips.

3. A device comprising:

a body with a substantially flat, rectangular surface;

means on said body, opposite said flat surface, for allowing said body to tilt slightly from its horizontal position;

means disposed in the plane of such surface for allowing a user to grasp the device;

a removable handlebar assembly adapted to extend upward from said flat surface;

said body being a board and having a pair of hand holes formed therein;

said means for grasping comprising:

a pair of rails disposed longitudinally on opposite sides of said body;

a pair of transversely disposed strips fastened to the underside of said body on both opposite sides of said longitudinal rocker and protruding laterally from said body;

each one of said rails fastened to respective ends of said pair of said strips.

4. A device comprising:

a body with a substantially flat, rectangular surface;

means on said body, opposite said flat surface, for allowing said body to tilt slightly from its horizontal position;

means disposed in the plane of such surface for allowing a user to grasp the device;

a removable handlebar assembly adapted to extend upward from said flat surface;

said body being a board and having a pair of hand holes formed therein;

said means for tilting comprising a longitudinal rocker and a transverse rocker, said rockers each having a curvature equal to each other;

said means for grasping comprising:

a pair of rails disposed longitudinally on opposite sides of said body;

a pair of transversely disposed strips fastened to the underside of said body on both opposite sides of said longitudinal rocker and protruding laterally from said body;

each one of said rails fastened to respective ends of said pair of said strips.

* * * * *